US005189373A

United States Patent [19]

Murata et al.

[11] Patent Number: 5,189,373

[45] Date of Patent: Feb. 23, 1993

[54] IGNITION APPARATUS FOR AN INTERNAL COMBUSTION ENGINE WITH ENGINE CYLINDER MISFIRING DETECTOR HAVING AN IONIZATION CURRENT NOISE FILTER

[75] Inventors: Shigemi Murata; Masayuki Ikeuchi, both of Himeji, Japan

[73] Assignee: Mitsubishi Denki Kabushiki Kaisha, Tokyo, Japan

[21] Appl. No.: 769,313

[22] Filed: Oct. 1, 1991

[30] Foreign Application Priority Data

Oct. 4, 1990 [JP] Japan ..... 2-265118

[51] Int. Cl.[5] ..... F02P 17/00

[52] U.S. Cl. ..... 324/399; 324/388; 324/392; 123/425

[58] Field of Search ..... 324/378, 388, 390, 391, 324/392, 393, 399; 123/425

[56] References Cited

U.S. PATENT DOCUMENTS

| | | | |
|---|---|---|---|
| 2,134,589 | 10/1938 | Stanek | 324/390 |
| 4,055,079 | 10/1977 | Dudziak | 324/392 |
| 4,762,106 | 8/1988 | Blauhut | 123/425 |
| 5,087,882 | 2/1992 | Iwata | 324/388 |

FOREIGN PATENT DOCUMENTS

| | | |
|---|---|---|
| 2507286 | 2/1975 | Fed. Rep. of Germany . |
| 3103605 | 1/1982 | Fed. Rep. of Germany . |
| 3921616 | 1/1990 | Fed. Rep. of Germany . |

*Primary Examiner*—Gerard R. Strecker
*Assistant Examiner*—Diep Do
*Attorney, Agent, or Firm*—Sughrue, Mion, Zinn, Macpeak and Seas

[57] ABSTRACT

An ignition apparatus for an internal combustion engine is provided in which malfunctions due to noise induced by a high ignition voltage can be avoided in a reliable manner. A controller controls the ignition timing of a cylinder of the engine in synchronism woth the rotation thereof. A detector 7–13 detects an ion current which is generated between the electrodes of the spark plug upon combustion of an air/fuel mixture in the cylinder. A filter 21 is connected to an input side of the detector for filtering noise contained in the ion current, the noise being induced by the ignition coil upon sparking of the spark plug. The ignition coil has a primary winding connected to the controller and a secondary winding connected to the spark plug. The filter is connected between the detector and a node P2 between the secondary winding of the ignition coil and the spark plug.

4 Claims, 4 Drawing Sheets

IGNITION APPARATUS FOR AN INTERNAL COMBUSTION ENGINE WITH ENGINE CYLINDER MISFIRING DETECTOR HAVING AN IONIZATION CURRENT NOISE FILTER

BACKGROUND OF THE INVENTION

The present invention relates to an ignition apparatus for an internal combustion engine, and more particularly, it relates to an ignition apparatus which is capable of preventing malfunctions due to noise induced by a high voltage generated upon discharge of a spark plug.

FIG. 3 shows a typical example of a known ignition apparatus for an internal combustion engine. In this figure, the apparatus illustrated includes a controller 1 in the form of a control unit for controlling the fuel injection timing and the ignition timing of an internal combustion engine in synchronism with the rotation thereof, a power transistor 2, an ignition coil 3, a reverse-current checking diode 4, and a spark plug 5. The ignition coil 3 has a primary winding connected to ground through the collector-emitter connection of the power transistor 2, and a secondary winding connected to one electrode of the spark plug 5 through the reverse-current checking diode 49 The spark plug electrode is also connected to a negative electrode of a DC power source 8 through a ion current sensing diode 6 and a resistor 7. A serial connection of a capacitor 9 and a resistor 10 is connected in parallel with a serial connection of the resistor 7 and the DC power source 8. A comparator 11 has a pair of first and second input terminals, the first input terminal being connected to a junction between the capacitor 9 and the resistor 10, and the second input terminal being connected to a reference voltage source. When a voltage imposed on the first input terminal exceeds the reference voltage at the second input terminal, the comparator 11 generates an output signal which is input as a reset signal to a pair of first and second counters 12, 13 which together constitute a binary counter. The first counter 12 is alternately actuated and deactuated or turned into a high and a low level by a clock pulse supplied thereto from a signal generator 19 through a comparator 20, which will be described in detail later, and it is reset by a reset signal from the comparator 11, so that it generates an output signal, as shown at (F) in FIG. 4. The second counter 13 generates a high output when a clock signal A is input to the first counter 12 during the time the first counter 12 is at a high level, and it is reset by a reset signal E from comparator 11.

The control unit 1 supplies a fuel injection signal to a fuel injector 14 which injects, based thereon, an appropriate amount of fuel into an intake pipe IP of the engine. The engine includes a cylinder 15 in which a piston 16 is received for reciprocating movement. The piston 16 is connected with a crankshaft 18 through a piston rod 17.

The signal generator 19 generates a control signal in synchronism with the rotation of the crankshaft 18. The control signal contains a series of pulses occurring at predetermined intervals. The control signal from the signal generator 19 is fed to the control unit 1 as well as the first counter 12 through the comparator 20 as a clock signal.

The operation of the above-mentioned known ignition apparatus will now be described in detail with reference to FIG. 4 which is a timing chart showing the waveforms of signals at various portions of the ignition apparatus.

Under the normal operating condition of the engine in which normal combustion takes place in the cylinder 15 without misfiring, in synchronization with an output or clock signal A from the signal generator 19, which is shown at (A) in FIG. 4, the control unit 1 generates a fuel injection control signal to the injector 14 and at the same time, it turns the power transistor 2 off so that a positive voltage is developed across the primary winding of the ignition coil 3, as shown at (B) in FIG. 4, and a negative voltage is developed across the secondary winding of the ignition coil 3, as shown in at (C) in FIG. 4, thereby causing the spark plug 5 to generate a spark. Upon sparking of the spark plug 5, an air/fuel mixture in the cylinder 15 is fired. As a result, between the electrodes of the spark plug 5 there is generated an ion current I which is supplied to the first input terminal of the comparator 11 through the diode 6 and the capacitor 9. The waveform of the ion current I thus supplied to the comparator 11 contains noise N, as illustrated at (D) in FIG. 4, which results from a high voltage generated upon sparking of the spark plug 5. When the comparator 11 receives the ion current I containing noise N at the first input terminal thereof, it generates an output signal in the form of a reset signal E, as shown at (E) in FIG. 4. In other words, within one period of the clock signal A from the signal generator 19, there is generated two types of reset signals, one type being due to noise and the other due to the ion current. As a consequence, the first counter 12, which is alternatively actuated and deactuated by a clock signal pulse and is reset by a reset signal pulse, is always reset by a reset signal due to noise, so that it generates an output signal F which rises at the rising edge of a clock pulse A and falls at the rising edge of a noise-induced reset pulse, as shown at (F) in FIG. 4. Accordingly, the second counter 13 generates no output or a low level output at all times, as shown at (G) in FIG. 4.

In this manner, the first and second counters 12, 13 of the known ignition apparatus operate irrespective of the presence and absence of an ion current, so when misfiring takes place at a time between time t2 corresponding to the rising edge of a square clock pulse and time t3 corresponding to the rising edge of the following clock pulse, it is impossible to detect this misfiring.

SUMMARY OF THE INVENTION

Accordingly, the present invention is aimed at overcoming the above problem encountered with the known ignition apparatus.

An object of the invention is to provide a novel and improved ignition apparatus for an internal combustion engine in which malfunctions due to noise induced by a high ignition voltage can be avoided in a reliable manner.

In order to achieve the above object, according to the present invention, there is provided an ignition apparatus for an internal combustion engine having an ignition coil and a spark plug with electrodes. The apparatus comprises: a controller for controlling the ignition timing of a cylinder of the engine in synchronism with the rotation thereof; a detector for detecting an ion current which is generated between the electrodes of the spark plug upon combustion of an air/fuel mixture in the cylinder; and a filter connected to an input side of the detector for filtering noise contained in the ion current, the noise being induced by the ignition coil upon sparking of the spark plug.

The ignition coil has a primary winding connected to the controller and a secondary winding to the spark plug, and the filter is connected between the detector and a node between the secondary winding of the ignition coil and the spark plug.

An ion-current sensing diode is provided which has an anode connected to the node between the secondary winding of the ignition coil and the spark plug, and a cathode connected to the filter.

Preferably, the filter comprises a plurality of diodes serially connected to each other between the cathode of the ion-current sensing diode and the detector, and a capacitor connected between the cathode of the ion-current sensing diode and ground.

The above and other objects, features and advantages of the invention will become more readily apparent from the following detailed description of a preferred embodiment of the invention taken in conjunction with the accompanying drawings.

DETAILED DESCRIPTION OF THE PREFERRED EMBODIMENT

A preferred embodiment of the invention will be described in detail while referring to FIGS. 1 and 2 of the accompanying drawings.

Figure 1:
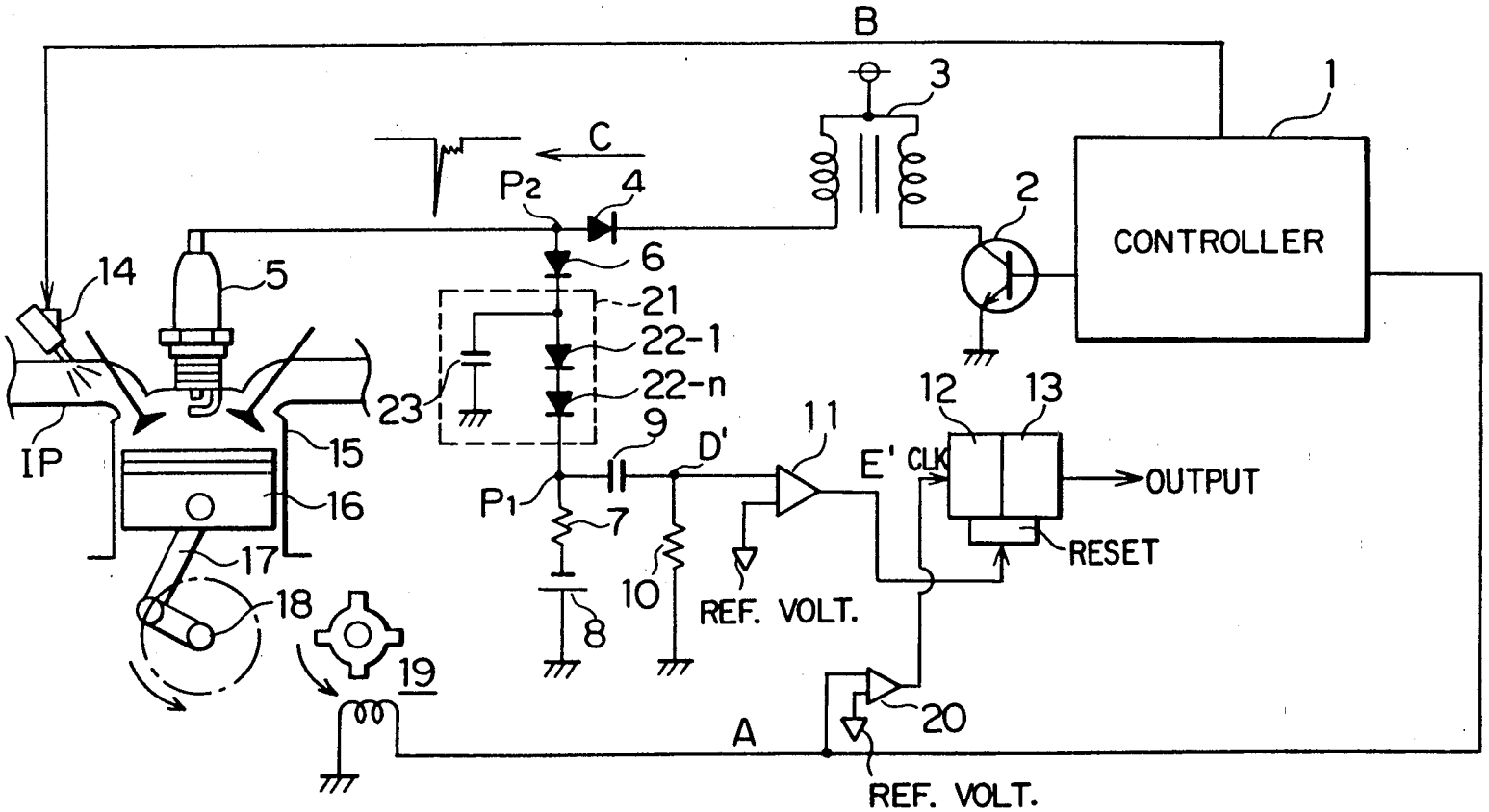
FIG. 1 is a schematic diagram showing the general arrangement of an ignition apparatus for an internal combustion engine according to the invention.
Figure 2:
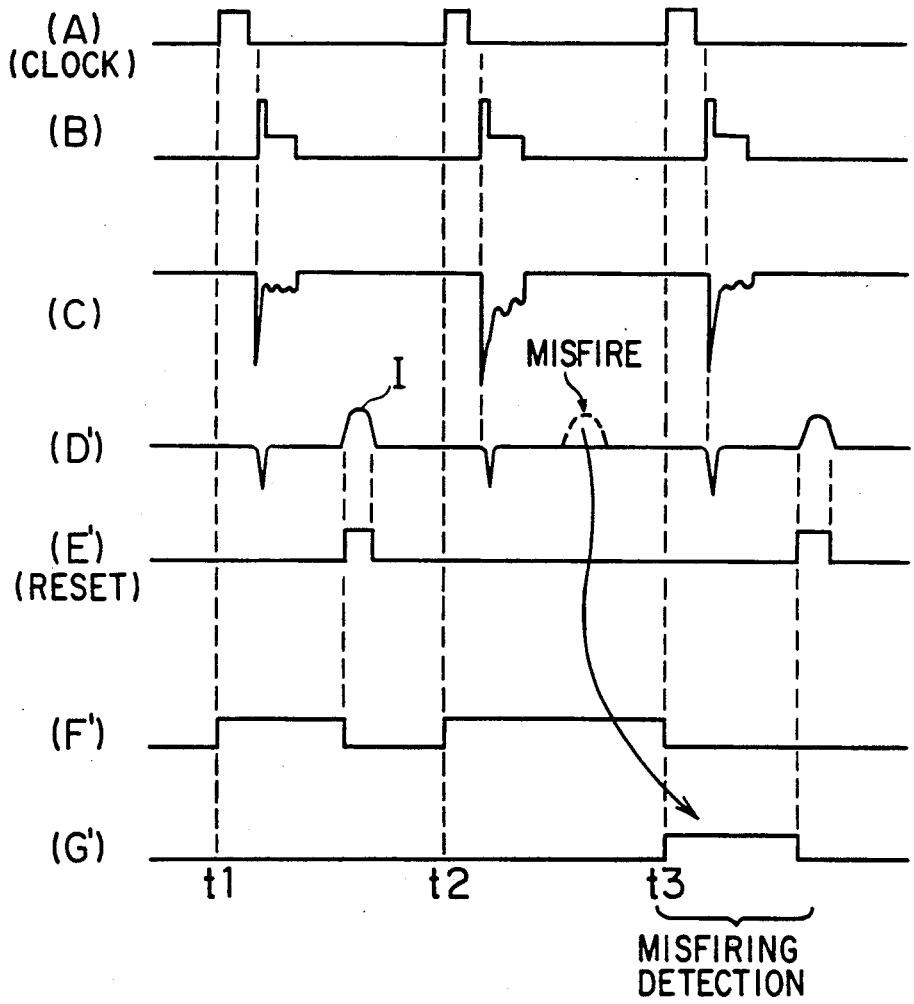
FIG. 2 is a waveform diagram showing the waveforms of signals at various portions of the ignition apparatus of FIG. 1.
Figure 3:
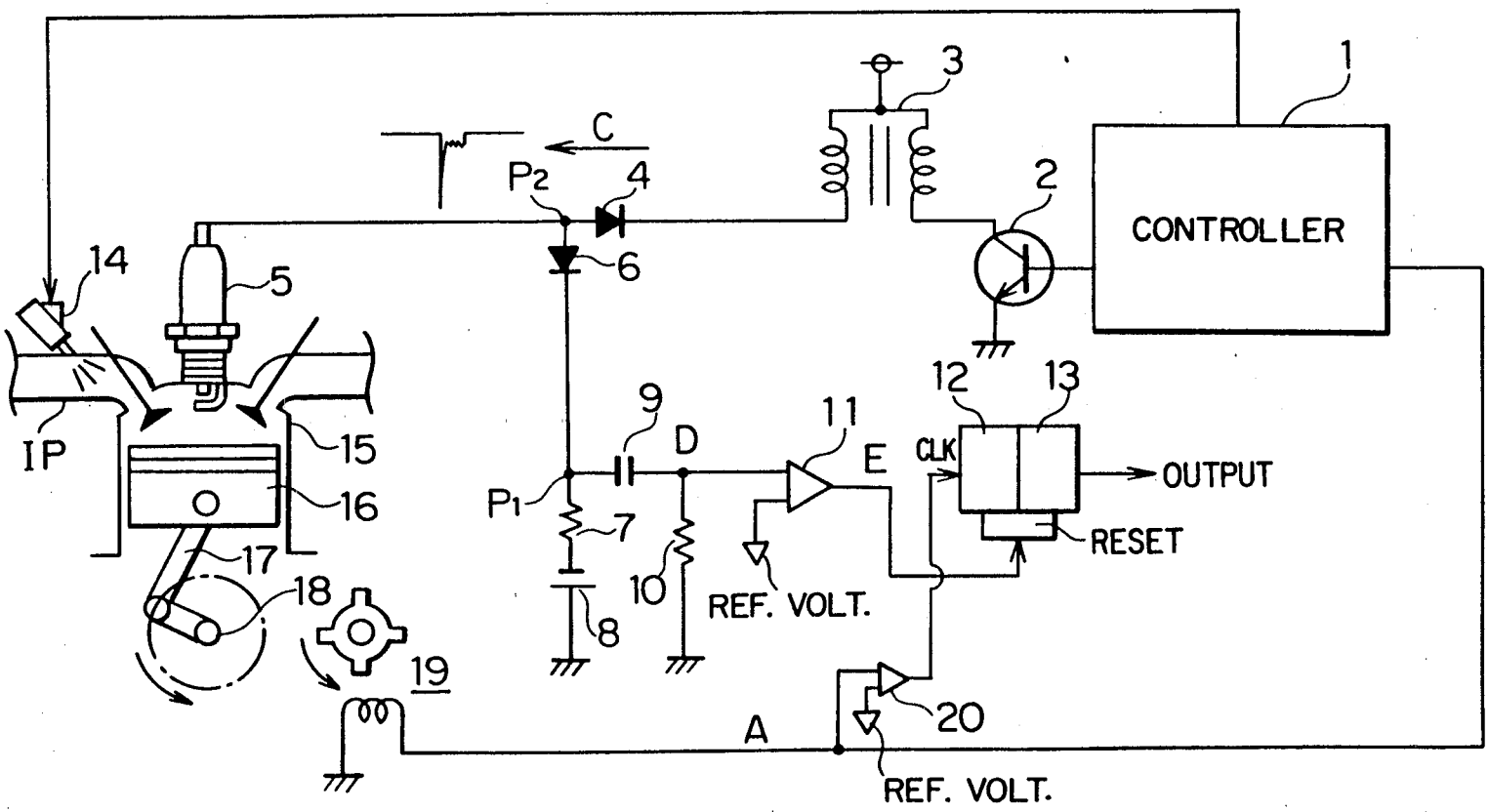
FIG. 3 is a view similar to FIG. 1, but showing a known ignition apparatus for an internal combustion engine.

Referring first to FIG. 1, there is shown an ignition apparatus for an internal combustion engine which is substantially similar in construction to the known ignition apparatus of FIG. 3 except for the provision of a noise filter, which is generally designated by reference numeral 21, for removing or reducing ignition noise contained in an ion current which is generated by combustion of an air/fuel mixture. Thus, the same elements of this embodiment as those of the known apparatus of FIG. 3 are identified by the same symbols as employed in FIG. 3.

The noise filter 21 is provided at an input side of a detector, which comprises elements 7 through 13, for detecting an ion current generated between the electrodes of a spark plug 5 upon combustion of an air/fuel mixture in a cylinder 15. For example, the noise filter 21 is connected between the cathode of a diode 6 and a junction $P_1$ between a resistor 7 and a capacitor 9. Specifically, the filter 21 includes a plurality of diodes 21-1 through 21-n, which are serially connected with each other between the cathode of the diode 6 and the junction $P_1$ with their polarities arranged as illustrated in FIG. 1, and a capacitor 23 connected between the cathode of the diode 6 and ground.

Figure 4:
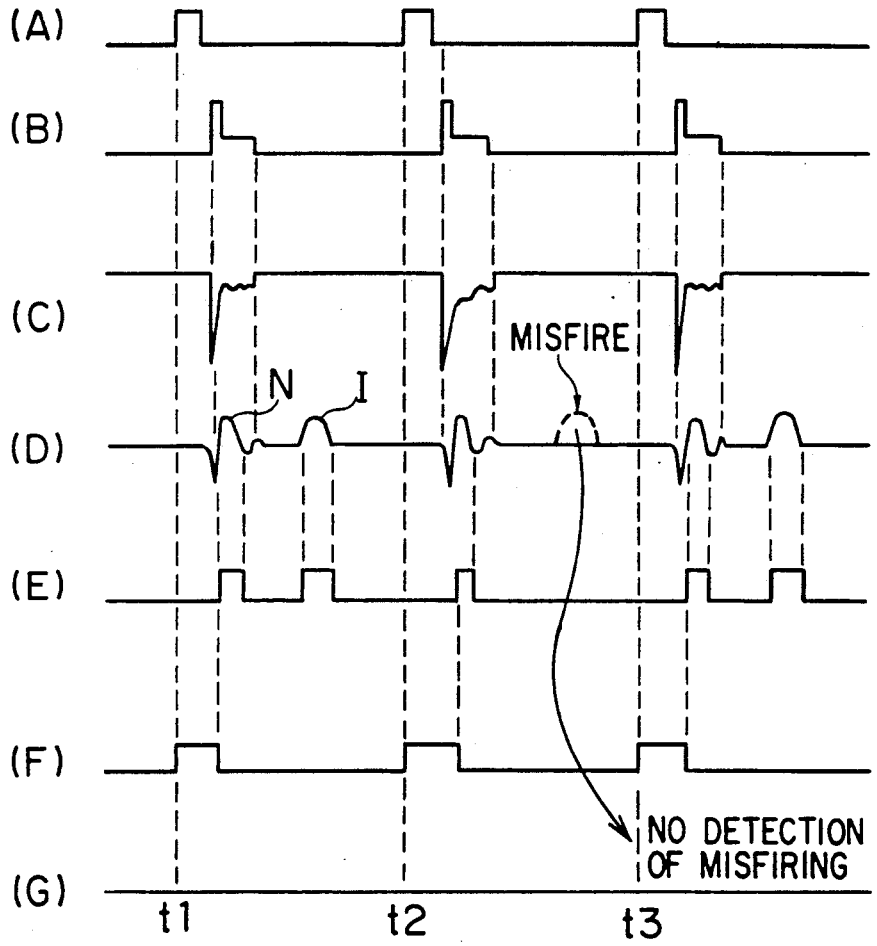
FIG. 4 is a view similar to FIG. 2, but with the known apparatus of FIG. 3.

The operation of this embodiment will now be described in detail while referring to the timing chart of FIG. 2. Let us first consider the case that the engine operates normally without misfiring in the cylinder 15. In the normal operating condition of the engine, in synchronization with an output or clock signal A from the signal generator 19, which is shown at (A) in FIG. 2, the control unit 1 generates a fuel injection control signal to the injector 14 and at the same time, it turns the power transistor 2 off so that a positive voltage is developed across the primary winding of the ignition coil 3, as shown at (B) in FIG. 2, and a negative voltage is developed across the secondary winding of the ignition coil 3, as shown in at (C) in FIG. 2, thereby causing the spark plug 5 to generate a spark. Upon sparking of the spark plug 5, an air/fuel mixture in the cylinder 15 is fired. As a result, between the electrodes of the spark plug 5 there is generated an ion current I which is supplied to the first input terminal of the comparator 11 through the diode 6, the noise filter 21 and the capacitor 9. In this connection, the ion current thus generated generally includes noise components N due to a high voltage induced by the ignition coil 3 upon every ignition or sparking of the spark plug 5, as shown at (D) in FIG. 4, but such noise components N can be substantially removed or reduced to a negligible extent by the noise filter 21 prior to reaching the comparator 11, as described in detail later. Thus, the waveform of the ion current I output by the filter 21 is shown at (D') in FIG. 2. When the comparator 11 receives the noise-filtered ion current I at the first input terminal thereof, it generates a reset signal E', as shown at (E') in FIG. 2. In this case, a single type of reset signal E' due to the ion current alone is generated within one period of the clock signal A from the signal generator 19. The reset signal E' thus generated is fed to the first and second counters 12, 13. As a consequence, the first counter 12 generates an output signal F' which rises at the rising edge of a clock pulse A and falls at the rising edge of an ion-current-induced reset pulse, as shown at (F') between time $t_1$ and time $t_2$ in FIG. 2. Accordingly, as shown at (G') in FIG. 4, the second counter 13 generates no output or a low level output at time $t_2$ at which a clock pulse A rises, thus detecting no misfiring in the cylinder 15.

Next, let us consider the case that misfiring takes place at a time between $t_2$ and $t_3$. In this case, no ion current is generated due to misfiring during the time between $t_2$ and $t_3$, so the comparator 11 generates no output or reset signal during this time period, as shown at E' in FIG. 2. Accordingly, as shown at (F') in FIG. 2, the output of the first counter 12 rises or becomes high at time $t_2$ at which a clock pulse A from the comparator 20 is input to the counter 12, and the high level output of the counter 12 falls or is reset at time $t_3$ at which the following clock pulse is input to the counter 12. As a result, the second counter 13 generates at $t_3$ a high level output which is then reset by a reset pulse E' from the comparator 11, as shown at (G') in FIG. 2, thus detecting misfiring in the cylinder 15.

More specifically, assuming in FIG. 3 that a noise voltage at a node $P_2$ between the diodes 4 and 6 is represented by Vn, a noise voltage at the junction $P_1$ by Von, an electrostatic capacitance between the junction $P_1$ and the node $P_2$ by $C_1$ and a capacitance between the junction $P_1$ and ground by $C_2$, the noise voltage Von is expressed as follows:

$$Von = C_1 \times Vn/(C_1 + C_2) \quad (1)$$

On the other hand, assuming in FIG. 1 that a noise voltage at the junction $P_1$ is represented by Von', and an electrostatic capacitance $C_1'$ between the junction $P_1$ and the node $P_2$ by $C_1'$, the noise voltage Von' is expressed as follows:

$$Von' = C_1' \times Vn/(C_1' + C_2) \quad (2)$$

From equations (1) and (2) above, it is established that $C_1$ is greater than $C_1'$ ($C_1 > C_1'$). Therefore, Von' is less than Von (Von' < Von). As a result, according to this embodiment, the effect of noise due to a high ignition voltage induced by the ignition coil 3 upon every ignition can be greatly reduced and hence substantially removed.

What is claimed is:

1. An ignition apparatus for an internal combustion engine having an ignition coil and a spark plug with electrodes, said apparatus comprising:

a) a controller for controlling the ignition coil to generate a high voltage firing signal for the spark plug, mounted in a cylinder of the engine, in synchronism with the rotation thereof; and b) means for detecting a misfiring of said engine cylinder; said misfiring detecting means comprising:

c) an ionization current detector (7-13) for detecting an ionization current generated between the electrodes of said spark plug upon combustion of an air/fuel mixture in the cylinder; and d) means for preventing a false detection due to a noise signal resulting from the high voltage firing signal, said preventing means comprising:

e) a filter (21) connected to an input side of said ionization current detector for filtering noise contained in the ionization current, the noise being induced by said ignition coil upon the firing of said spark plug.

2. An ignition apparatus according to claim 1, wherein said ignition coil has a primary winding connected to said controller and a secondary winding connected to said spark plug, and said filter is connected between said ionization current detector and a node between the secondary winding of said ignition coil and said spark plug.

3. An ignition apparatus according to claim 2, further comprising an ionization-current sensing diode (6) having an anode connected to said node between the secondary winding of said ignition coil and said spark plug, and a cathode connected to said filter.

4. An ignition apparatus according to claim 3, wherein said filter comprises a plurality of diodes (22) serially connected to each other between the cathode of said ionization-current sensing diode and said detector, and a capacitor (23) connected between the cathode of said ionization-current sensing diode and ground.

* * * * *